US006152035A

United States Patent [19]

Scholtz et al.

[11] Patent Number: 6,152,035

[45] Date of Patent: Nov. 28, 2000

[54] MAGNETIC SUPPORT PLATE FOR CLADDED STEEL AND STEEL-BACKED POLYMER STAMPING/BLOCKING AND EMBOSSING GRAPHIC ARTS DIES

[75] Inventors: Todd E. Scholtz, Olathe; Fred F. Duarte, Mission, both of Kans.; Dennis F. Hendrix, Grandview, Mo.

[73] Assignee: Universal Engraving, Inc., Overland Park, Kans.

[21] Appl. No.: 09/466,611

[22] Filed: Dec. 17, 1999

[51] Int. Cl.[7] ..... B41F 27/00

[52] U.S. Cl. ..... 101/389.1; 335/285

[58] Field of Search ..... 101/389.1; 335/285

[56] References Cited

U.S. PATENT DOCUMENTS

| | | | |
|---|---|---|---|
| 3,312,167 | 4/1967 | Lash | 101/389.1 |
| 3,496,866 | 2/1970 | Wystrand | 101/389.1 |
| 3,721,189 | 3/1973 | Bray | 101/389.1 |
| 3,734,017 | 5/1973 | Trier | 101/389.1 |
| 3,810,055 | 5/1974 | Wright | 101/389.1 |
| 3,973,770 | 8/1976 | Montenbrum | 101/389.1 |
| 4,823,697 | 4/1989 | Randazzo | 101/389.1 |
| 5,904,096 | 5/1999 | Fawcett et al. . | |

OTHER PUBLICATIONS

Bunting Magnetics Co. Brochure, Catalog No. 1650, Bunting Hot Stamping Bases:.

*Primary Examiner*—Eugene Eickholt

*Attorney, Agent, or Firm*—Hovey, Williams, Timmons & Collins

[57] ABSTRACT

A magnetic support plate for cladded steel and steel-backed polymer stamping/blocking and embossing graphic arts dies is provided in which a non-ferrous, rectangular support member (14, 114, 214) made up of a plate (26, 126, 226) has a die mounting surface (24) for complementally receiving the graphic arts die assembly (12). The plate (26, 126, 226) has a series of elongated recesses or cavities (28, 128, 228) in one face thereof, with each of the cavities being provided with two rectangular magnets that are located in spaced relationship one from another. The two magnets within each cavity are disposed in positions with the magnetic north and south poles thereof opposite one another. A ferro-magnetic component (36) in the form of a steel plate or strip is provided within each cavity in bridging, contacting relationship to both of the magnets within each cavity. The magnets serve to magnetically attract and hold the cladded steel or steel-backed polymer stamping/blocking and embossing dies against the surface (24) of plate (26, 126, 226). The ferro-magnetic component (36) significantly enhances the magnetic attractive force of the magnets.

34 Claims, 3 Drawing Sheets

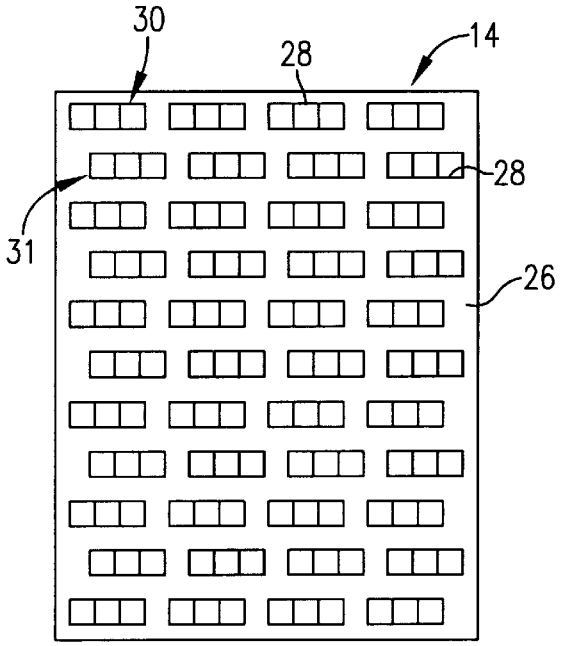
FIG. 10.
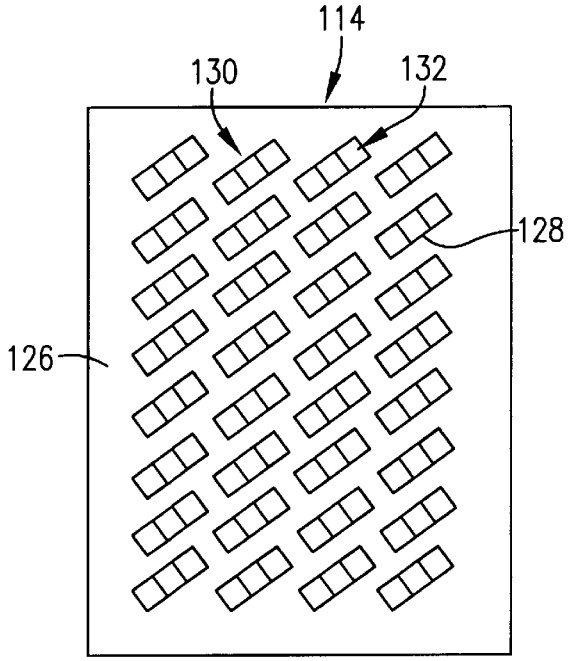
FIG. 11.
FIG. 12.
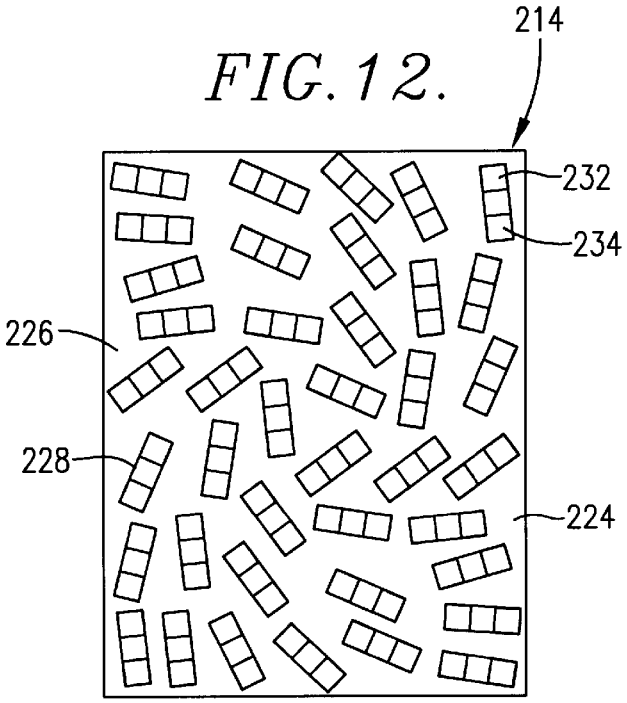

MAGNETIC SUPPORT PLATE FOR CLADDED STEEL AND STEEL-BACKED POLYMER STAMPING/BLOCKING AND EMBOSSING GRAPHIC ARTS DIES

FIELD OF THE INVENTION

This invention relates to the field of graphic arts and especially to a magnetic support plate for facilitating the mounting of a graphic arts impression die on the chase of a sheet or web-fed graphic arts presses, such as clamshell, vertical or horizontal presses. As used herein, the term graphic arts "impression die(s)" means at least the categories of graphic arts dies including hot foil stamping/blocking dies, embossing dies, debossing dies, embossing/debossing dies, combination/fluted/one-shot/foil embossing dies, and any other graphic arts dies which combine any one or more of these general types of die functions on a single plate for smooth, lenticular, textured or grained surfaces, or any other similar graphic arts metal, polymeric or composite impression dies.

In particular, the invention concerns an improved support plate for graphic arts impression dies on the chase of a sheet or web-fed stamping/blocking or embossing press which eliminates the need for securing the die to the chase in a precise location and for ease of adjusting the position the die for final registration using conventional mechanical devices, adhesives or the like, thus providing for faster changeover, quicker makeready and quicker registration of dies, with reduced down time of the press.

The magnetic support plate of this invention also has utility for supporting a cladded die plate having a steel-backed, non-ferrous, design-defining layer during etching or engraving of the design in the non-ferrous layer.

DESCRIPTION OF THE PRIOR ART

Stamping/blocking or blocking dies have long been used in the graphic arts field to apply thin metal foil or thin layers of other transferable material to a substrate such as paper, cardboard, thin metal films or plastic in accordance with a design formed in the stamping/blocking surface of the die. Similarly, embossing dies have been provided to emboss or deboss a desired design in a suitable substrate, and to produce lenticular lines, texturing or graining in the paper, plastic, thin metal film or cardboard. Combination dies which combine hot foil stamping/blocking, flat stamping/blocking, hot or cold embossing or hot or cold debossing, or formation of other surface feature designs are also well known in the art.

Stamping or blocking dies as described have long been prepared by etching or engraving a desired design in the outer surface of a metal plate, usually steel, magnesium, copper or brass. These metal plates generally were of sufficient thickness, as for example about ¼ in. (the standard for North America, Central America and South America, "the Americas") and about 7 mm (the standard in the rest of the world "ROW"), to cause the plate to be essentially self-sustaining. In the case of relatively long embossing or stamping/blocking runs involving as many as hundreds of thousands of sheets, it has been past practice to employ relatively long lived die plates made of a metal such as steel, copper or brass. For intermediate length runs, the plates were usually made out of magnesium which was less expensive and easier to engrave or etch a relieved design area than with steel, copper or brass.

In those instances where the runs are shorter and any inherent wear of the die surface is acceptable from a final product quality standpoint, non-metal graphic arts dies have largely supplanted copper and brass, and even magnesium plates in more recent times by less costly and simpler non-metal dies. For example, steel-backed photopolymer die plates have been developed in which a hardened photo polymeric composition representing the desired design is supported on a steel backing plate. These steel-backed photopolymer plates can be used with conventional foil stamping/blocking and embossing equipment.

Photopolymer die plates are generally thinner than conventional magnesium, steel, copper or brass graphic arts dies, and therefore a solid spacer plate has been required between the photopolymer die plate and the chase of the stamping/blocking or embossing machine to avoid the necessity of modifying the embossing or stamping/blocking equipment. U.S. Pat. No. 5,904,096 ("'096") of May 18, 1999, shows and illustrates one type of plate that can be used to support a photopolymer die plate on the chase of an embossing or stamping/blocking machine. The plate of the '096 patent is provided with a series of permanent magnets which are described as being capable of magnetically attracting and holding the steel plate portion of the die plate and thereby the photopolymer die assembly on the plate. Use of a plate of an appropriate thickness serves to support the photopolymer die in relationship from the surface of the chase.

An improved metal graphic arts impression die which substantially has the longevity of conventional copper or brass dies, yet is less costly and easier to manufacture than conventional metal dies made of steel, copper or brass, is disclosed in application for U.S. Ser. No. 09/392,179 ("'179") filed Oct. 9, 1999, entitled "Non-Ferrous/Steel Laminated Graphic Arts Dies and Method of Producing Same," assigned to the assignee hereof, and which is incorporated herein by specific reference thereto. The impression die illustrated and described in the '179 application is made up of a cladded metal die plate having a design-defining, non-magnetic metal layer such as copper, bronze or non-ferrous metal which is cladded to a ferro-magnetic support layer that preferably comprises a steel sheet. A relieved area in the non-ferrous layer defines the design to be foil stamped, embossed, debossed or impressed. In a preferred form, the laminated metal graphic arts die plate has a layer of copper clad to a sheet of steel.

As further disclosed in the '179 application, because the preferred laminated die plate is thinner than conventional one-piece magnesium, steel, copper or brass stamping/blocking dies or embossing dies, a die plate support is provided for holding the laminated die plate on the chase of a graphic arts stamping/blocking or embossing machine. The support plate in the '179 application, which is of non-ferrous material, carries a series of permanent magnets in specifically spaced relationship to magnetically attract the steel layer of the laminated die plate and to thereby magnetically hold the latter in a predetermined position on the chase of the press.

It has been found though that the die support plate having a plurality of magnets incorporated therein does serve the intended purpose of removably attaching the cladded metal die plate to the chase in a manner which allows quick makeready and change out without the necessity of using clamps for securing the die plate to the chase in a predetermined, precise position. This is especially true from the standpoint of affixation of the die to the support plate in a manner which substantially eliminates drifting movement of the die plate from its initial position on the chase during press operation and particularly during long runs.

However, there is a need for securing a steel-backed polymer graphic arts die to a support plate using magnets for attracting the steel backing of the die to the support plate, which more firmly affixes the steel-backed polymer die to the support plate than is the case using a magnetic die support plate as illustrated and described in the '096 patent.

Graphic arts stamping/blocking, embossing and combination dies are mounted on chases which are standardized as to thickness in the Americasbased on the English system of measurement, and on the metric system in ROW. In addition, the distance between the chase and platen of web and sheet-fed grahic arts embossing and stamping/blocking presses has been maintained by all press manufacturers at a relatively fixed value. Therefore, where a support plate is provided with magnets for securing a steel-backed graphic arts die assembly to the chase of a stamping/blocking or embossing press in a predetermined location on the chase, the support plate and associated magnets must be sufficiently thin to fit within the normal distance between the chase and platen of the press while still accommodating the die assembly, the material to be stamped or embossed, and any counter material between the platen and the die plate assembly, while at the same time providing for firm attachment of the die assembly to the support plate.

SUMMARY OF THE INVENTION

An improved magnetic support plate is provided for a steel-backed, graphic arts impression die assembly made up of a non-ferrous support member having a die mounting surface which substantially complementally receives a cladded steel or steel-backed impression die. A plurality of specifically spaced magnetic elements are embedded in the support member substantially through the full extent thereof. The attractive force of the steel backing to the magnetic surface of the support plate is enhanced by positioning of the magnets embedded in the support member such that adjacent pairs of the magnets have their north and south poles oriented oppositely, and a ferro-magnetic component is positioned in bridging relationship to each pair of magnets against the faces thereof opposite the die support face of the plate to enhance the magnetic flux emanating from each of the pairs of magnets.

The provision of a magnetic plate for supporting a steel-backed impression die has a major benefit in the use of the assembly in that minute adjustments in the position of the die on the support plate after mounting of the assembly on the chase of the sheet or web-fed press may be accomplished with greater facility and more rapidly than in past mounting practices wherein repositioning of the die could be accomplished only by time-consuming manipulation of a number of fastening devices.

In a preferred embodiment of the invention, the magnets are of square shape, with each pair of magnets being in specifically spaced relationship from one another, and from adjacent pairs of magnets. The magnets of each pair are positioned such that their north and south pole axes extend through the major faces of each of the magnets, with the length and width dimensions of each of the magnets being substantially greater than the thickness of each magnet. The ferro-magnetic component is preferably in the nature of a steel plate that extends between and engages the major face of each of the magnets which is most remote from the die mounting surface of the support member.

The steel strip which extends between and engages the major face of each of the magnets most remote from the die mounting surface of the support member, enhances the holding power of the bridged magnets by directing and concentrating the magnetic field surrounding those ends of the magnets in closest proximity to the die assembly supporting surface of the support member. The ferro-magnetic component also functions to decrease the flux leakage from the magnets at the perimeter of the magnetic field created by respective pairs of magnets.

The individual magnets are embedded in the non-ferrous support member in positions causing the major faces thereof in closest proximity to the die mounting surface of the support member to be spaced inwardly from the plane of the outer die mounting surface. The magnets are not however spaced so far from the die mounting surface to significantly decrease the magnetic attractive flux of the magnets or the die assembly. In this way, the magnets are protected against wear or breakage during the frequent attachment to and detachment of the magnetic support plate graphic arts die assemblies from the magnetic support member. Furthermore, a smooth and consistent outer die support surface is presented that is not interrupted by the outer surface of the magnets to thus minimize any distortion of the design-defining layer.

The magnetic support member of this invention is also useful to support a cladded steel or steel-backed graphic arts impression die made up of a non-ferrous, design-defining layer backed by steel during removal of material from the surface of the non-ferrous layer by etching to form the design image in the outer surface thereof, and for supporting the cladded steel die as the design image is engraved in the outer surface of the non-ferrous layer.

It is therefore an important object of the invention to provide an improved magnetic support plate for cladded steel and steel-backed graphic arts impression dies for mounting of each die on the chase of a stamping/blocking and/or embossing press wherein the support member may be affixed to the chase using conventional clamps for that purpose, and then the die assembly placed on the magnetic support plate at a desired position for precise alignment with the object to be embossed or stamped. The position of the die assembly on the magnetic support plate may be adjusted to a macro or micro extent as necessary for correct alignment with the image to be stamped or embossed, by merely shifting the die assembly on the support plate and thus completely doing away with the usual time-consuming practice of adjusting the position of the die by manipulating a series of conventional clamps received in apertures therefor in the chase as provided by the magnetic pattern so as to allow consistent movement.

BRIEF DESCRIPTION OF THE DRAWINGS

FIG. 10 is a reduced scale view of the rear face of the support member as depicted in FIGS. 1–3;

FIG. 11 is an alternate embodiment of the support member and illustrating pairs of magnets in angular disposition with respect to opposed margins of the support member; and FIG. 12 is a preferred embodiment of the support member and showing pairs of magnets embedded in the support member which are located in a random pattern with respect to one another.

DETAILED DESCRIPTION OF THE PREFERRED EMBODIMENTS

Figure 1:
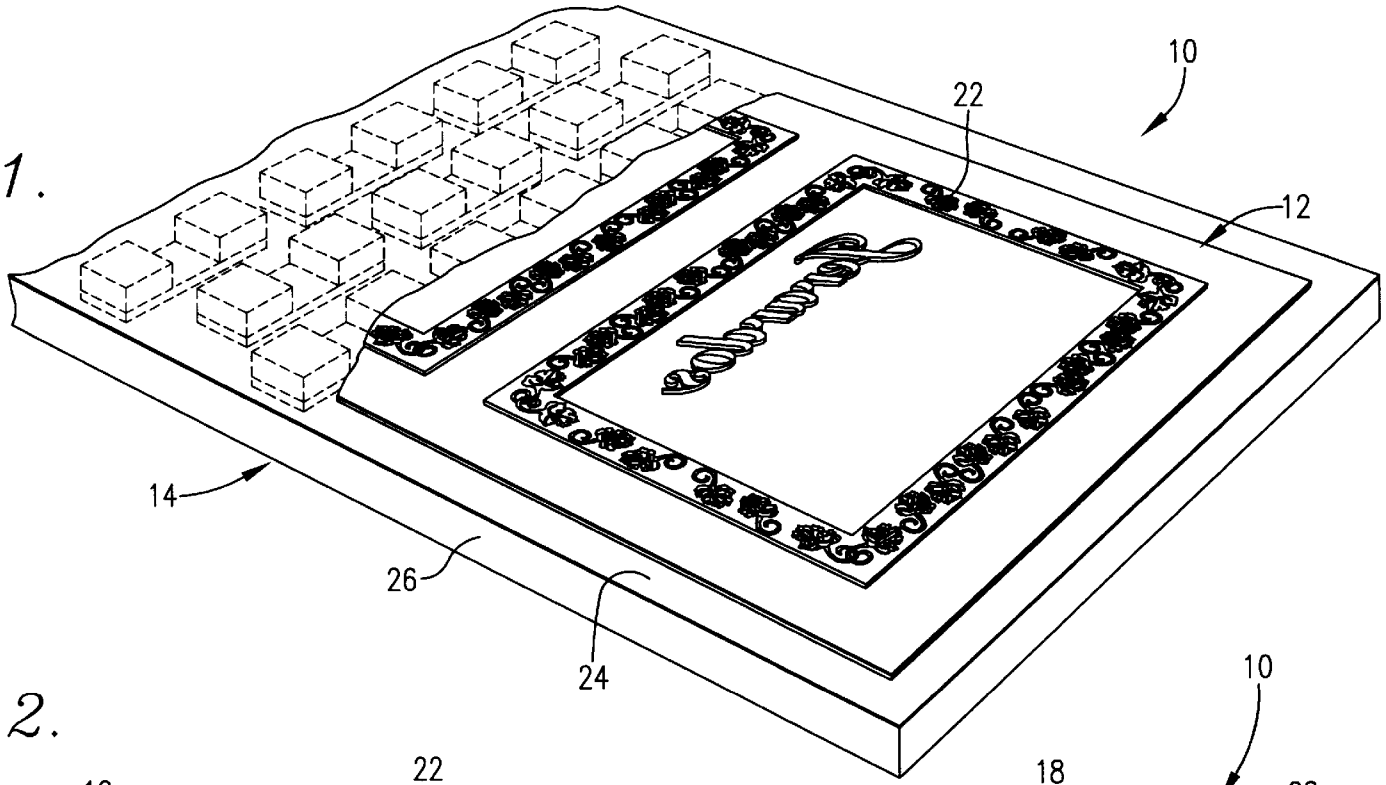
FIG. 1 is a fragmentary perspective view of a graphic arts impression die assembly mounted on an improved magnetic support plate constructed in accordance with the preferred embodiment of the present invention.
Figure 2:
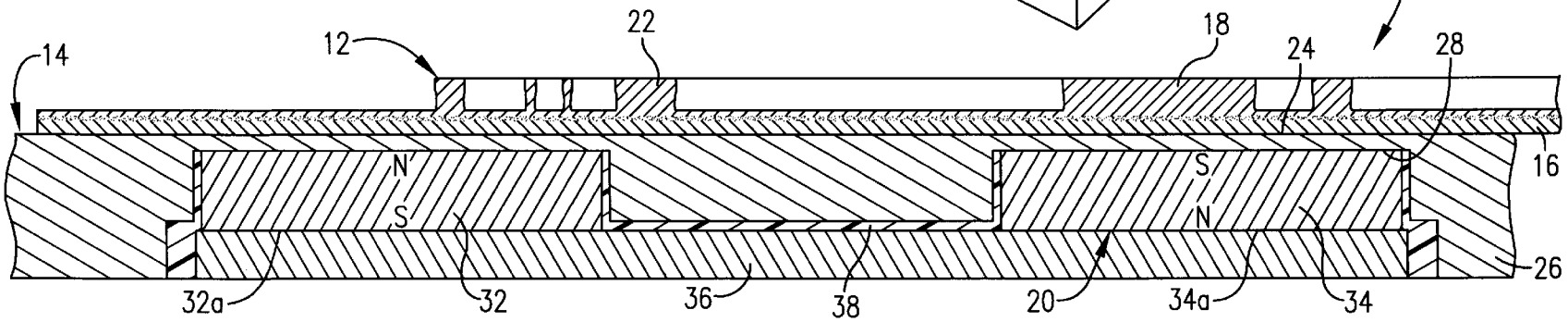
FIG. 2 is an enlarged, fragmentary, essentially schematic, vertical, cross-sectional view of the impression die assembly and non-ferrous support member therefor as shown in FIG. 1.
Figure 3:
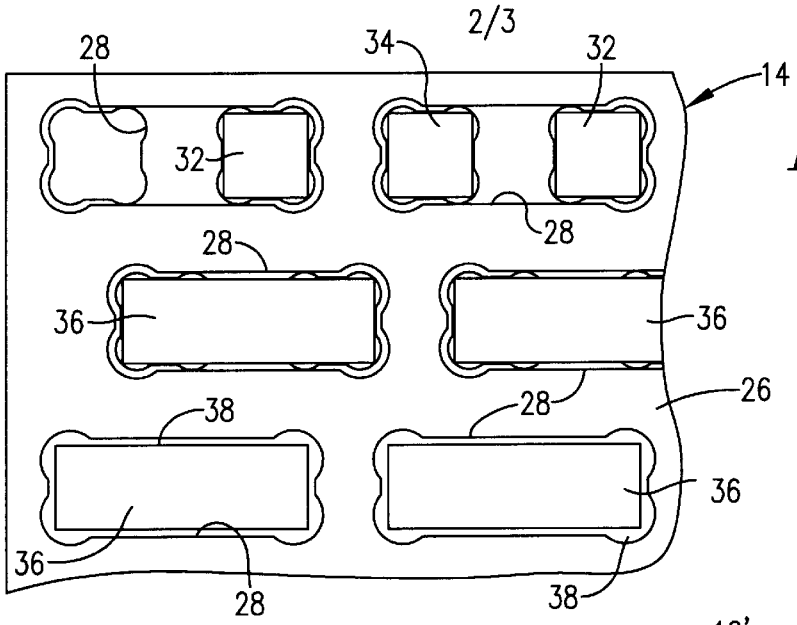
FIG. 3 is a fragmentary bottom view of one corner of the support member as illustrated in FIG. 1, and showing the location, positioning, and details of construction of the magnets embedded in the support member.

A graphic arts impression die unit broadly designated 10 is shown in FIGS. 1 and 2 and in the embodiment illustrated in these figures comprises a cladded steel impression die assembly 12 removably mounted on a magnetic support member 14. The cladded steel impression die assembly 12 as shown in these figures is for illustrative purposes only, and it is to be understood that any type of graphic arts impression dies as described above may be mounted on support member 14 for purposes of the present invention.

The metal blank for preparation of die plate assembly 12 is preferably a cladded metal plate made up of a steel sheet or layer 16, and a non-ferrous sheet or layer 18 which is integral throughout the extent thereof with layer 16. Utilization of a cladded metal plate for preparation of a graphic arts impression die having a ferro-magnetic base layer while the layer of material that is cladded to the base layer is a non-ferrous metal, allows advantage to be taken of the ability of the cladded plate to be attracted to and held in place in a desired location by support member 14 which includes a plurality of permanent magnets, each of which is broadly designated 20.

Accordingly, a cladded die plate blank which is useful in the present invention has a ferro-magnetic base layer, although the non-ferrous metal layer cladded to the base layer may be of various materials, such as copper, bronze, magnesium and similar metals which are amenable to etching by a suitable etchant solution, or can be engraved to produce the required design-defining image in the surface of the non-ferrous layer of the plate. Copper is a metal of choice for the non-ferrous layer of the cladded metal die plate in that it can readily be etched in with a ferric chloride solution, and especially a ferric chloride solution containing an additive for controlling the degree and rate of the etching process. Magnesium is another non-ferrous material that may be cladded to the steel base layer, in that the magnesium may be etched in a conventional manner with a nitric acid solution of well known composition in the engraving die field. Bronze on the other hand, is a metal of choice for the non-ferrous layer of the cladded metal die plate in instances where the design image in the outer surface of the non-ferrous layer is formed by mechanical milling, as for example by a pantograph milling machine.

In the cladding process, which may be carried out in a manner that has long been conventional in the cladding industry, a strip of non-ferrous metal is brought into surface engagement with a strip of steel and the two layers in proximal relationship are fed between one or more compression rollers which apply extremely high surface pressures on opposite sides of the non-ferrous metal and steel sheets. In order to assure integration of the non-ferrous metal sheet with the steel sheet, as depicted schematically in FIG. 2, the pressure applied to the interengaging non-ferrous metal and steel sheets should be sufficient to assure complete cladding of the non-ferrous metal to the steel layer.

In the case of a cladded metal impression die assembly 12 of steel and copper, the copper layer is desirably of from about 0.020 in. (0.508 mm) to about 0.090 in. (2.286 mm) in thickness, and the steel layer is from about 0.008 in. (0.203 mm) to about 0.200 in. (5.080 mm) in thickness. The preferred copper/steel cladded die plate blank has a steel layer which is nominally 0.030 in. (0.762 mm) in thickness and a copper layer which is nominally 0.040 in. (1.016 mm) thick. A blank of that total thickness presents a relatively rigid structure, and is therefore useful in flat bed applications. The representative, relatively rigid copper/steel cladded die assembly 12 as for example shown in FIGS. 1 and 2 may be prepared from a cladded metal blank having a nominal total thickness of about 0.070 in. (1.778 mm). In this exemplary cladded die plate, the carbon steel layer 16 has a nominal thickness of about 0.015 in. (0.318 mm), while the copper layer 18 is about 0.055 in. (1.397 mm) throughout its extent prior to etching of the surface thereof. Part of the copper layer 18 is then removed by an etchant solution or mechanical milling to present a relieved design image 22, as depicted in FIGS. 1 and 2.

Alternately, the die assembly may comprise a layer of polymeric material presenting the design image which is applied to and firmly affixed to a ferro-magnetic sheet such as steel backing sheet 16. The polymeric material is preferably a thermoset resin selected from the group consisting of allyl polymers, epoxy polymers, furan, melamine formaldahyde, melamine phenolic polymers, phenolic polymers, polybutyldiene polymers, thermoset polyester and alkyd polymers, thermoset polyimide polymers, thermoset polyurethane polymers, flexible thermoset silicone polymers, silicone epoxy polymers, and thermoset urea polymers, all of which have properties and characteristics permitting their utilization in a well known manner to prepare what is conventionally known in the graphic arts field as a polymeric die.

In view of the fact that a cladded die plate such as die plate assembly 12, or a polymeric die carried by steel backing, are both of less thickness than conventional rigid magnesium, steel, brass or copper graphic arts impression dies, the magnetic support member 14 of this invention functions to not only carry the die assembly, but also serves as a shim between the die plate and the chase of the press. In the case of a hot foil stamping press, the backing member must be capable of efficiently transferring adequate heat from the heated chase of the web or sheet-fed graphic arts press to the design image-defining copper layer 18 of die plate 20, or a polymeric die plate. Therefore, steel is desirably used for the layer 16 of die plate assembly 12, as well as for the polymeric die assembly, not only because of its heat retention properties and its high strength to weight ratio, but also because the steel is magnetically attracted to and held by the die mounting surface 24 of magnetic support member 14.

Magnetic support member 14 preferably comprises a relatively rigid, non-ferrous metal plate 26 (or of non-heat conductive materials such as plastic or wood for non-heat applications) of width and length dimensions greater than the die plate assembly 12, or a steel-backed polymeric die plate assembly that is to be mounted thereon, so as to provide complete support for the die plate assembly throughout the width and length thereof. The support plate 26 is preferably fabricated of materials such as bronze, brass, copper alloys, aluminum alloys, magnesium alloys, nickel, zinc, titanium, wood, thermoplastic and thermoset synthetic resin compounds, synthetic resin composites comprising tempered glass fiber, metal fiber, carbon fiber or graphite fiber reinforced thermoset resins such as epoxies or bakelite, with copper alloy being a preferred material.

Plate 26 should be of a thickness such that when a die plate assembly 12, or a steel-backed polymeric die assembly is mounted thereon, as illustrated in FIGS. 1 and 2, the combined thickness dimension of plate 26 and die plate assembly 12 is approximately equal to the thickness of a conventional graphic arts impression die, i.e., about 0.250 in. (6.350 mm) for the Americas, and about 7 mm (0.276 in.) for ROW. Therefore, the thickness of the magnetic support member 14 should not exceed about 0.230 in. (5.842 mm) in the case of the Americas, and about 6.502 mm (0.256 in.) in the instance of ROW, taking into account the minimum thickness of a die plate assembly of about 0.020 in. (0.508 mm).

In the embodiment of the invention illustrated in FIGS. 2, 3, 7 and 10, the plate 26 has a series of elongated, generally rectangular recesses or cavities 28 in the rear face thereof which may be formed for example by machining operations and that terminate in spaced relationship from the die plate assembly mounting surface 24 of the plate. As is most evident in the embodiment shown in FIGS. 3 and 10, the cavities 28 are arranged in aligned rows extending transversely of the plate 26. For example, as best shown in FIG. 10, the cavities 28 of the row 30 thereof, are offset with respect to the cavities 28 of the row 31. The offset positions of the cavities 28 repeats from row to row with the cavities 28 of adjacent rows being offset from one another.

Each of the cavities 28 houses a pair of rectangular magnets 32 and 34 which are of a width and length substantially greater than the thickness thereof. The thickness of each of the magnetic elements is from at least about 0.040 in. (1.016 mm) to about 0.220 in. (5.588 mm) for the Americas, and about 0.246 in. (6.248 mm) for ROW. A preferred magnet may for example be of square configuration having dimensions of 0.5 in. (12.7 mm)×0.5 in. (12.7 mm) in width and length and 0.10 (2.54 mm) in. in thickness. In the preferred embodiments of the invention, the magnets 32 and 34 are spaced apart a distance of about 0.5 in. (12.7 mm). Magnets may be used that are from about 0.25 in. (6.35 mm)×0.25 in. (6.35 mm) to about 2 in. (50.8 mm)×2 in. (50.8 mm) with a spacing between adjacent magnets being about 0.10 in. (2.54 mm) for smaller magnets to about 3 in. (76.2 mm) for larger magnets within the specified magnets may be used. It is also to be understood in this respect that the cavities 28 should be spaced such that the distance between magnets in adjacent cavities are substantially within the ranges set forth for the magnets 32 and 34 in each cavity 28 and the spacing therebetween, depending upon the sizes of the magnets and the corresponding spacing between magnets 32 and 34 in each cavity 28. Thus, with respect to FIG. 10 for example, the spacing betwen adjacent rows 30 and 31 will be about 0.5 in. (12.7 mm) in the instance where the magnets 32 and 34 are 0.5 in. (12.7 mm)×0.5 in. (12.7 mm) and the spacing between such magnets is 0.5 in. (12.7 mm). Similarly, the spacing between cavities 28 in each row 30 and 31 will be about 0.5 in. (12.7 mm) in the exemplary embodiment.

A ferro-magnetic component 36 in the form of a steel strip is located within each of the cavities 28 in bridging, engaging relationship to the outer surfaces 32*a* and 34*a* respectively of magnets 32 and 34 which are remote from the die assembly mounting surface 24 of plate 26. The ferro-magnetic component 36 may be steel, but vanadium-iron-nickel alloy (Permendor) is preferred because of its enhanced magnetic permeability, and is of a thickness of from about 0.010 in. (0.254 mm) to about 0.190 in. (4.826 mm) for the Americas and 0.216 in. (5.486 mm) for ROW. A preferred component has a thickness of about 0.060 in. (1.524 mm). The total thickness of each magnet 32 and 34 and the associated ferro-magnetic component 36 is at least about 0.050 in. (1.270 mm). A preferred thickness of magnetic support member 14 is about 0.180 in. (4.572 mm) for the Americas and 0.206 (5.232 mm) in ROW, with the distance between the die mounting surface 24 of member 14 and the adjacent upper surfaces of magnets 32 and 34 being about 0.020 in. (0.508 mm). An epoxy potting compound 38 serves to permanently affix the magnets 32 and 34 in respective cavities 28. The recommended operating temperature during use of the magnetic support member 14 is usually within the range of about ambient to 500 F.

The magnets 32 and 34 within each cavity 28 are positioned such that the north pole of magnet 32 for example is in closest proximity to the mounting surface 24 of plate 26 while the south pole of the magnet 32 is in adjacent relationship to the strip 36, as illustrated schematically in FIG. 2. As shown schematically in that same figure, the south pole of the magnet 34 is in closest proximity to the die assembly mounting surface 24 of plate 26, and the north pole of that magnet is adjacent strip 36. Thus, magnets 32 and 34 are mounted in each of the cavities 28 with opposite polarity.

The strength of magnets 32 and 34 is a function of the amount of magnetic flux available from a unit volume of the magnet material and the shape of the magnet, and is generally expressed in units of MGOe (Mega gauss orsted). The preferred magnet material for the present invention is selected from the group of samarium-cobalt (SmCo) having an MGOe of 16–32 and neodymium-iron-boron (NdFeB) having an MGOe of 24–48. Aluminum-nickel-cobalt (Alnico) having an MGOe of 2–8 can be used in certain instances provided the material is adequately engineered to produce a stronger magnet assembly. SmCo magnet material is most preferred because of its low temperature of remanence (Br), making it well suited for strong holding magnet assemblies operating at higher temperatures, as is the case with hot foil stamping/blocking dies.

Magnetic support member 14 serves to removably and releasably hold a die assembly thereon as depicted in FIGS. 1 and 2, wherein the steel layer 16 of die assembly 12 for example rests against and is magnetically attracted to the die mounting surface 24 of plate 26 by magnets 32 and 34.

It is known that a magnetic circuit is the path which the magnetic flux from a magnet chooses to travel. Components in a magnetic circuit include the magnet, which acts as the source, along with air, other magnetic insulating material, and ferro-magnetic materials. All components other than the magnets act as impediments or reluctance to the flow of magnetic flux. The magnetic flux will choose to travel through the path that presents the least reluctance. Thus, reluctance in a magnetic circuit reduces the amount of magnetic flux from the magnet.

The magnetic attraction of a steel-backed die assembly to the magnetic support member 14 is significantly enhanced by the steel strips 36 bridging magnets 32 and 34 within each cavity 28 because of the significantly greater magnetic permeability of the steel as compared with air and the material from which plate 26 is fabricated.

Figure 4:
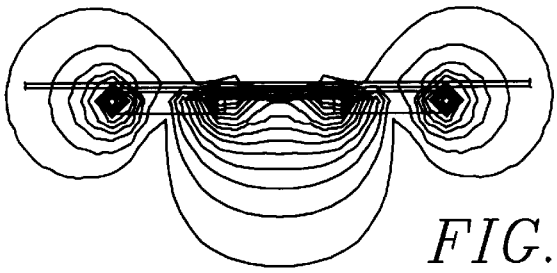
FIG. 4 is a schematic representation of the flux field generated by an adjacent pair of spaced magnets without provision of a ferro-magnetic strip in bridging relationship to the pair of magnets.
Figure 5:
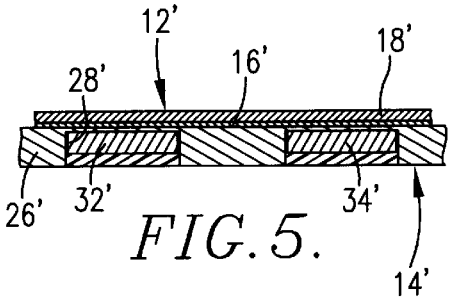
FIG. 5 is an enlarged, essentially schematic, vertical, cross-sectional view through the assembly illustrated in FIG. 4.
Figure 6:
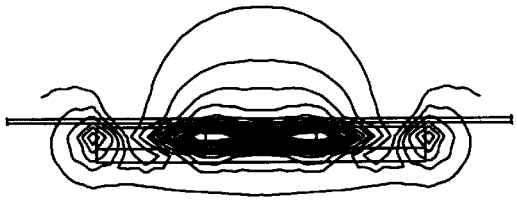
FIG. 6 is a schematic representation of the magnetic flux field generated by an adjacent pair of spaced magnets where a ferro-magnetic strip is positioned in bridging relationship to the pair of magnets.

This magnetic flux density enhancement and reduction of magnetic leakage is graphically illustrated by the depictions of FIGS. 4 and 6. In FIG. 5, the magnets 32' and 34' within cavity 28' of plate 26' do not have a ferro-magnetic member located in bridging relationship to the underside of the magnets. The magnets 32' and 34', for purposes of the illustration in FIG. 5 are assumed to be of the same size as magnets 32 and 34, spaced the same distance apart as magnets 32 and 34 and fabricated of SmCo. A cladded die assembly 12' is mounted on plate 24 of magnetic support member 14' with the steel backing layer 16' of assembly 12' resting against and magnetically attracted to the die mounting surface of plate 26'. The non-ferrous upper layer 18' of assembly 12' is presumed to be copper.

The magnetic flux density field that will surround the components shown in FIG. 5 having the assumed construction and configuration is depicted in FIG. 4 wherein it can be seen that the lines of magnetic force predominantly extend downwardly from the magnetic support member 14', and surround opposite ends of the cavity containing the magnets 32' and 34'. It is also apparent from this assumed construction and configuration that the lines of magnetic force below the cavity 28 and at the ends thereof 28' rapidly increase in spacing in a direction below and to the sides of the magnets 32' and 34'.

Figure 7:
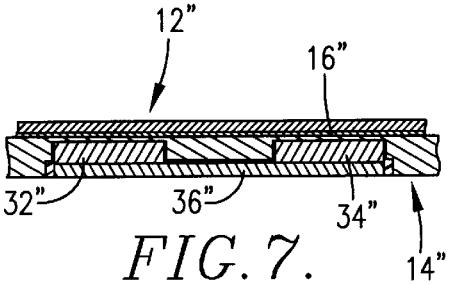
FIG. 7 is an enlarged, essentially schematic, vertical, cross-sectional view through the assembly illustrated in FIG. 6.

On the other hand, and as illustrated in FIG. 7, when magnets 32" and 34" of the size and spacing described with respect to FIG. 5, are provided with a ferro-magnetic bridging strip 36" therebetween, the magnetic flux field produced is predominantly above the die assembly 12" mounted support member 14". The magnetic lines of force at the ends of each of the cavities 28" are also much closer together and therefore magnetically stronger than the lines of force surrounding the cavities 28' of FIG. 4. The result is that the die assembly 12" is magnetically attracted toward the magnetic support member 14" to a significantly greater degree than the attraction of die assembly 12' toward magnetic support member 14'.

Three dimensional boundary element method analyses have demonstrated that the magnetic holding force of two 32 MGOe 0.5×0.5×0.1 in SmCo magnets spaced 0.5 in. apart and in which the two magnets 32" and 34" were bridged by a steel strip 36" as shown in FIG. 7 confirms that the magnetic holding force is at least approximately three times greater than that of the holding force of the magnet arrangement as shown in FIG. 5 wherein a steel strip bridging the two magnets is omitted. Furthermore, in the same test setup, the degree of leakage of magnetic flux from the arrangement of FIG. 7 has been reduced by a factor of thirteen as compared with the arrangement of FIG. 5.

In the alternate embodiment of the invention illustrated in FIG. 11 of the drawings, the magnetic support member 114 is made up of a plate 126 having rows 130 of cavities 128 in which the cavities are offset from the next adjacent row 132 whereby all of the cavities of each row are offset from the cavities of a row proximal thereto. In addition, all of the rows 130 and 132 of cavities 138 are at an angle of about 45 with respect to the transverse and longitudinal axes of plate 126. Each of the cavities 128 are provided with two magnets such as 32 and 34, and an associated ferro-magnetic bridging component such as strip 36. The magnets and the ferro-magnetic strip are similar in construction, dimensions, orientation and operation as described with respect to magnetic support member 14.

The magnetic support member 214 as shown in FIG. 12 of the drawings is the preferred support member. In this instance, magnetic support member 214 has a plate 226 in which the cavities 228 are arranged in random order across the extent of the plate. Again, the cavities 228 are each provided with two magnets and an associated ferro-magnetic strip the same as magnets 32 and 34 and strip 36 of the magnet support member 14. The size of the magnets 232 and 234 and the spacing therebetween within cavities 228 should also be within the ranges previously described with respect to magnets 32 and 34 within cavities 28 in the embodiment of the invention illustrated in FIGS. 2 and 10. However, because of the random positioning of the cavities 228 as shown in FIG. 12, it has been determined that the combined holding power of all of the magnets 232 or 234 within the array thereof of member 214 is not significantly impaired notwithstanding the fact that the magnets within each cavity 228 are not spaced apart exactly the same distance as the magnets 32 and 34 within cavities 28 for example, as is also the case of the other embodiments of the invention.

The random patten of cavities 228 in support member 214 has an added advantage over the arrangement over the cavities 28 and 128 in that there is less tendency for a graphic arts impression die assembly mounted on the surface 224 of member 214 to shift laterally of the member 214 in any direction during use of a unit made up of a die assembly and the support member 214. Linear and lateral misalignment of the cavities 228 in the pattern of the FIG. 12 embodiment of the invention prevents the magnetic fields of adjacent cavities 228 from working in what could be additive alignment.

Figure 9:
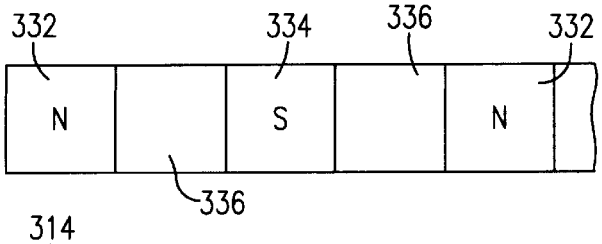
FIG. 9 is a fragmentary, essentially schematic view looking down at the support member and associated magnets illustrated in FIG. 8.
Figure 8:
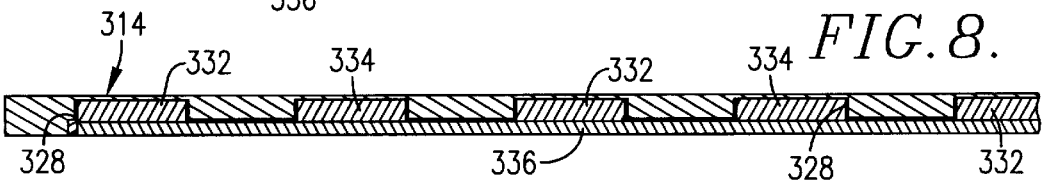
FIG. 8 is a fragmentary, enlarged, essentially schematic, vertical, cross-sectional view of an alternate embodiment of the invention wherein a series of spaced magnets embedded in the non-ferrous support member are located in a line, with a single strip of ferro-magnetic material extending beneath all of the aligned magnets.

A further alternate embodiment of the invention is shown in FIGS. 8 and 9, wherein the magnetic support member 314 has a series of magnet pairs 332 and 334 of opposite polarity within respective cavities 328 as described with respect to magnetic support member 14. However, in this instance, a single strip 336 extends between the faces of magnets 332 and 334 opposite the die mounting surface 324 of the member 314 for each of the transverse rows of magnets 332. Alernatively, the ferro-magnetic component underlying the magnets 32 and 34 may comprise a single metal sheet or member embracing all of the magnets embedded in a support member, or may take the form of any number of ferro-magnetic components engaging the faces of magnets in more than one row thereof.

We claim:

1. A magnetic support plate for cladded steel and steel-backed graphic arts impression dies comprising:

a non-ferrous support member having a die mounting surface for substantially complementally receiving a cladded steel or steel-backed stamping/blocking or embossing die;

a plurality of magnetic elements each having opposed faces with the magnetic north pole being at one face of each element and the south pole being at the opposed face of each element, said magnetic elements being embedded in the support member in spaced relationship from one another with adjacent pairs of the magnetic elements being disposed in positions with the magnetic north and south poles of one of the magnetic elements of each pair oriented opposite the north and south pole disposition of the other magnetic element of a respective pair; and a ferro-magnetic component associated with each of said pairs of magnetic elements and located adjacent the faces thereof remote from said die mounting surface of the member in substantially bridging relationship to each of said pair of magnetic elements for increasing the magnetic force of each pair of magnetic elements adjacent the die mounting surface of the member to enhance the magnetic attraction of a die toward the mounting surface of the member.

2. A magnetic support plate as set forth in claim 1, wherein said support member has an elongated recess therein for receiving each of said pair of magnetic elements in said spaced relationship from one another, each of said recesses extending inwardly from a face of the support member opposite said mounting surface thereof, adjacent recesses being located in spaced disposition from one another.

3. A magnetic support plate as set forth in claim 2, wherein each of said recesses terminates in spaced relationship from said die mounting surface of the support member.

4. A magnetic support plate as set forth in claim 2, wherein the faces of the magnetic elements adjacent said mounting surface of the support member are in generally parallel relationship with the latter.

5. A magnetic support plate as set forth in claim 2, wherein each of said magnetic elements is of generally polygonal configuration.

6. A magnetic support plate as set forth in claim 5, wherein each of said magnetic elements is of generally rectangular configuration and each of the components is of a size and shape to at least partially overlap said opposed faces of each of said pair of magnetic elements.

7. A magnetic support plate as set forth in claim 2, wherein said pairs of magnetic elements and the recesses receiving respective pairs of magnetic elements are arranged in a series of individual, spaced rows extending across a transverse dimension of the support plate.

8. A magnetic support plate as set forth in claim 7, wherein the spacing between adjacent rows of recesses with a respective pair of magnetic elements therein is about 0.5 in. (12.7 mm).

9. A magnetic support plate as set forth in claim 7, wherein said recesses and the magnetic elements received therein of one row thereof is offset with respect to the recesses and corresponding magnetic elements therein in a proximal row.

10. A magnetic support plate as set forth in claim 9, wherein said support member is of generally rectangular configuration and the elongated recesses each containing a pair of magnetic elements are oriented at an angle with respect to the transverse axes of the support member.

11. A magnetic support plate as set forth in claim 1, wherein the ferro-magnetic component substantially complementally engages a respective adjacent face of each of the magnetic elements.

12. A magnetic support plate as set forth in claim 1, wherein said pairs of magnetic elements are arranged in a random pattern.

13. A magnetic support plate as set forth in claim 1, wherein each of said magnetic elements is of a thickness no greater than the thickness of the support plate.

14. A magnetic support plate as set forth in claim 1, wherein each of said magnetic elements is of a thickness less than the thickness of the support plate.

15. A magnetic support plate as set forth in claim 14, wherein the face of each of the magnetic elements in closest proximity to the die mounting surface of the support member terminates in spaced relationship to said die mounting surface.

16. A magnetic support plate as set forth in claim 15, wherein each of the magnetic elements is of a thickness substantially greater than the distance between the die mounting surface of the support member and the face of each magnetic element in closest proximity relationship thereto.

17. A magnetic support plate as set forth in claim 16, wherein the thickness of the magnetic elements is from about 0.040 in. (1.016 mm) to about 0.220 in. (5.588 mm).

18. A magnetic support plate as set forth in claim 17, wherein the thickness of each of the magnetic elements is about 0.10 in. (2.54 mm).

19. A magnetic support plate as set forth in claim 1, wherein the total thickness of the support member with the magnetic elements embedded therein does not exceed about 0.256 in. (6.502 mm).

20. A magnetic support plate as set forth in claim 19, wherein the thickness of each of the magnetic elements is at least about 0.040 in. (1.026 mm).

21. A magnetic support plate as set forth in claim 20, wherein the thickness of each of the components is at least about 0.010 in. (0.254 mm).

22. A magnetic support plate as set forth in claim 21, wherein the thickness of each of the components is from about 0.010 in. (0.254 mm) to about 0.216 in. (5.486 mm).

23. A magnetic support plate as set forth in claim 22, wherein the thickness of each of the components is about 0.060 in.

24. A magnetic support plate as set forth in claim 2, wherein each of the magnetic elements is of rectangular configuration of greater width and length than thickness.

25. A magnetic support plate as set forth in claim 24, wherein each of the magnetic elements is of a length of from about 0.25 in. (6.35 mm) to about 2 in. (50.8 mm) and a width of from about 0.25 in. (6.35 mm) to about 2 in. (50.8 mm).

26. A magnetic support plate as set forth in claim 24, wherein each of the magnetic elements is of a length of from about 0.25 in. (6.35 mm) to about 2 in. (50.8 mm) and a width of from about 0.25 in. (6.35 mm) to about 2 in. (50.8 mm), and the thickness of the magnetic element is from about 0.040 in. (1.016 mm) to about 0.220 in. (5.588 mm).

27. A magnetic support plate as set forth in claim 26, wherein each of the magnetic elements is of dimensions approximately 0.50 in.×0.50 in.×0.10 in.

28. A magnetic support plate as set forth in claim 1, wherein the magnetic elements of each of said pairs thereof are spaced apart a distance of from about 0.10 in. (2.54 mm) to about 3 in. (76.2 mm).

29. A magnetic support plate as set forth in claim 28, wherein each of the magnetic elements is of a length of about 0.5 in. (12.7 mm), a width of about 0.5 in (12.7 mm), a thickness of about 0.10 in. (2.54 mm), and the spacing between the magnetic elements of each of said pairs thereof being about 0.5 in. (12.7 mm).

30. A graphic arts impression die assembly for mounting on a support unit of graphic arts impression apparatus and comprising:

a non-ferrous support member having a die mounting surface;

a die mounted on said die mounting surface of the support member;

a plurality of magnetic elements each having opposed faces with the magnetic north pole being at one face of each element and the south pole being at the opposed face of each element, said magnetic elements being embedded in the support member in spaced relationship from one another with adjacent pairs of the magnetic elements being disposed in positions with the magnetic north and south poles of one of the magnetic elements of each pair oriented opposite the north and south pole disposition of the other magnetic element of a respective pair; and a ferro-magnetic component associated with each of said pairs of magnetic elements and located adjacent the faces thereof remote from said die mounting surface of the member in substantially bridging relationship to each of said pair of magnetic elements for increasing the magnetic force of each pair of magnetic elements adjacent the die mounting surface of the member to enhance the magnetic attraction of the die toward the mounting surface of the member.

31. A die assembly as set forth in claim 30, wherein the total thickness of the support member with the magnetic elements embedded therein and the die mounted on said mounting surface of the support member does not exceed about 0.276 in. (7 mm).

32. A die assembly as set forth in claim 30, wherein said die is a cladded metal plate having a first non-ferrous layer bonded mechanically to a second ferrous layer, said ferrous layer of the die engaging said die mounting surface of the support member.

33. A die assembly as set forth in claim 30, wherein said die is a plate having a first polymeric layer bonded to a second ferrous layer, said ferrous layer of the die engaging said die mounting surface of the support member.

34. A method of supporting cladded steel and steel-backed graphic arts impression dies for use in sheet or web-fed graphic arts presses comprising:

providing a non-ferrous support member having a die mounting surface for substantially complementally receiving a cladded steel or steel-backed stamping/blocking or embossing die;

providing a plurality of magnetic elements each having opposed faces with the magnetic north pole being at one face of each element and the south pole being at the opposed face of each element with said magnetic elements embedded in the support member in spaced relationship from one another with adjacent pairs of the magnetic elements disposed in positions with the magnetic north and south poles of one of the magnetic elements of each pair oriented opposite the north and south pole disposition of the other magnetic element of a respective pair; and concentrating the magnetic field surrounding those ends of the magnetic elements in closes proximity to the die assembly supporting surface of the support member and decreasing the flux leakage from the magnets at the perimeter of the magnetic field created by respective pairs of magnets by positioning a ferro-magnetic component adjacent the faces of the magnetic elements remote from said die mounting surface of the member in substantially bridging relationship to each of said pair of magnetic elements.

* * * * *